US007188926B2

(12) United States Patent
Soga et al.

(10) Patent No.: US 7,188,926 B2
(45) Date of Patent: Mar. 13, 2007

(54) FILLER SOLUTION FOR INKJET HEAD, INKJET HEAD, AND RECORDING APPARATUS

(75) Inventors: Mamoru Soga, Osaka (JP); Hidekazu Arase, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 257 days.

(21) Appl. No.: 10/456,445

(22) Filed: Jun. 6, 2003

(65) Prior Publication Data

US 2004/0141037 A1 Jul. 22, 2004

(30) Foreign Application Priority Data

Jun. 13, 2002 (JP) ..... 2002-172263

(51) Int. Cl.
*B41J 2/165* (2006.01)

(52) U.S. Cl. ..... 347/28; 347/96; 347/21

(58) Field of Classification Search ..... 347/28, 347/21, 20, 95, 96, 22, 29
See application file for complete search history.

(56) References Cited

U.S. PATENT DOCUMENTS

| | | | | |
|---|---|---|---|---|
| 6,224,185 | B1 * | 5/2001 | Fassler et al. | 347/28 |
| 6,264,730 | B1 | 7/2001 | Matsumura et al. | |
| 2003/0117472 | A1 * | 6/2003 | Pearlstine et al. | 347/97 |

FOREIGN PATENT DOCUMENTS

| | | |
|---|---|---|
| JP | 09-327934 | 12/1997 |
| JP | 10-212439 | 8/1998 |
| JP | 11-293167 | 10/1999 |
| JP | 11-315231 | 11/1999 |
| JP | 2000-108493 | 4/2000 |
| JP | 2000-178494 | 6/2000 |

* cited by examiner

*Primary Examiner*—Manish S. Shah
(74) *Attorney, Agent, or Firm*—Harness, Dickey & Pierce, P.L.C.

(57) ABSTRACT

A filler solution of the present invention, which is supplied to fill an inkjet head, contains water and a hydrolyzate of a silicon compound which has a hydrophilic group.

10 Claims, 4 Drawing Sheets

FILLER SOLUTION FOR INKJET HEAD, INKJET HEAD, AND RECORDING APPARATUS

BACKGROUND OF THE INVENTION

1. Field of the Invention

The present invention relates to a filler solution for an inkjet head, an inkjet head which is filled with the filler solution, and a recording apparatus having such an inkjet head.

2. Description of the Prior Art

Conventionally, an inkjet head for ejecting ink from a nozzle based on a piezo method or bubble-jet method to form an image on a recording medium has been known.

In the case where such an inkjet head or a recording apparatus including such an inkjet head is transported, e.g., in the case where it is shipped from its manufacturer, an ink passage in the inkjet head is filled with a filler solution in place of ink.

This is because if the ink passage is filled with ink, the ink can coagulates due to a change in environment during the transportation thereof so that the inkjet head can be clogged with the coagulated ink.

If the ink passage is left vacant, an air bubble can remain in the ink passage when ink is supplied to fill the vacant inkjet head, and the air bubble can cause ejection failure. For example, in the case of a piezo-type inkjet head, the ink in the ink passage is pressured by deformation of a piezoelectric element, whereby the ink is ejected from a nozzle. In the case of a bubble jet-type inkjet head, the ink in the ink passage is pressured by an air bubble which is generated by heating the ink, whereby the ink is ejected from a nozzle. In such inkjet heads, if an air bubble remains in the ink passage, a pressure exerted on the ink is absorbed due to a contraction of the remaining air bubble, and as a result, ejection failure is caused, i.e., the ink is not ejected from the nozzle.

There have already been filler agents for an inkjet head which have improved fillability into the ink passage. For example, Japanese Unexamined Patent Publication No. 9-327934 discloses a filler solution which contains triethylene glycol monomethylether and N-(β-aminoethyl)ethanolamine. Japanese Unexamined Patent Publication No. 2000-108493 discloses a filler solution which contains triethylamine, glycerol, diethyleneglycol, and water.

The filler solution supplied to fill the inkjet head is replaced by ink when use of the inkjet head is begun. When the filler solution is replaced by ink, an air bubble sometimes happens to be trapped in the ink passage. The air bubble trapped in the ink passage is generally removed from the ink passage as the filler solution (and ink) is ejected from a nozzle. Further, the air bubble trapped in the ink passage can be removed by so-called cleaning, i.e., by sucking out the ink from a nozzle of the inkjet head.

However, an air bubble trapped in the ink passage sometimes attaches to a wall which defines the ink passage (i.e., an internal surface of the inkjet head). It is difficult to remove such an air bubble attached to the wall by cleaning, so that the air bubble sometimes remains in the inkjet head even after the cleaning.

Thus, even in the case where the inkjet head is filled with a filler solution, such an air bubble remaining in the inkjet head can causes ejection failure of the ink-jet head.

Ink used in inkjet recording generally contains a colorant (dye or pigment), a humectant, and water. However, an image formed with the ink on a recording medium has poor water-resistivity. That is, when the image is exposed to water, the colorant exudes into the water.

In Japanese Unexamined Patent Publication No. 10-212439, Japanese Unexamined Patent Publication No. 11-293167, Japanese Unexamined Patent Publication No. 11-315231, and Japanese Unexamined Patent Publication No. 2000-178494, adding a hydrolyzable silane compound (organic silicon compound) to ink in order to improve the water-resistivity of an image formed with the ink on a recording medium has been proposed. When a drop of such ink containing a silane compound is adhered on a recording medium, and a water content (solvent) of the ink drop evaporates or permeates into the recording medium, the silane compound remaining on the recording medium is condensation-polymerized, and this condensation-polymerized silane compound encloses a colorant. As a result, even when the image formed on the recording medium is exposed to water, the colorant is prevented from exuding into the water.

Such water-resistant ink has a relatively high viscosity as compared with commonly-employed ink (i.e., ink not containing a hydrolyzable silane compound). Thus, when a filler solution in the inkjet head is replaced by the water-resistant ink, an air bubble is readily trapped in the ink passage, and accordingly, the air bubble readily attaches onto the internal surface of the inkjet head.

That is, in the case of employing water-resistant ink, an air bubble remains in the inkjet head more readily in comparison with a case of commonly-employed ink. As a result, the possibility of causing ejection failure of the inkjet head is increased.

SUMMARY OF THE INVENTION

The present invention was conceived in view of the above circumstances. An objective of the present invention is to improve a filler solution for filling an ink-jet head. Specifically, an objective of the present invention is to prevent ink-ejection failure of the inkjet head.

A filler solution of the present invention is a filler solution for an ink-jet head, which is supplied to fill the inkjet head.

The filler solution contains water and a hydrolyzate of a silicon compound which has a hydrophilic acid.

According to this structure, the filler solution contains a hydrolyzate of a silicon compound. Thus, in the case where the inkjet head is filled with this filler solution, a silanol portion of the hydrolyzate of the silicon compound is chemisorbed on an internal surface of the inkjet head (i.e., a surface of the inkjet head which comes into contact with the ink or filler solution and which is generally made of a metal, such as stainless steel, or the like, glass, ceramic, etc.). Since the hydrolyzate of the silicon compound has a hydrophilic group, the internal surface of the inkjet head on which the hydrolyzate of the silicon compound is chemisorbed becomes hydrophilic. Even if an air bubble is trapped in the inkjet head when the filler solution in the inkjet head is replaced by ink, attaching of the air bubble onto the internal surface of the inkjet head is suppressed because the internal surface is hydrophilic. As a result, the air bubble trapped in the inkjet head is evacuated out of the inkjet head together with the filler solution (or ink) as it is ejected therefrom or is evacuated out of the inkjet head by the cleaning operation. In this way, the air bubble is prevented from remaining in the inkjet head. Thus, ejection failure of the inkjet head is prevented.

Further, when the filler solution in the inkjet head is replaced by water-resistant ink containing a hydrolyzable silane compound, a large number of air bubbles can be trapped in the inkjet head. However, even when a large number of air bubbles are trapped in the inkjet head, the trapped air bubbles are readily evacuated out of the inkjet head.

A large number of air bubbles may be trapped in the inkjet head not only at the time when the filler solution in the inkjet head is replaced by the ink, but also even after the filler solution in the inkjet head is replaced by the ink. For example, such a problem may occur when the ink cartridge for containing ink to be supplied to the ink-jet head is exchanged to a new one. However, an air bubble which is trapped in the ink-jet head when the ink cartridges are exchanged is also readily evacuated out of the inkjet head because the internal surface of the inkjet head is hydrophilic.

Furthermore, there is a case where gas (oxygen or the like) dissolved in the ink is expanded due to a change in the internal pressure of the inkjet head to emerge as an air bubble in the inkjet head. The air bubble that emerged is also readily evacuated out of the inkjet head because the internal surface of the inkjet head is hydrophilic.

As described above, only by filling the inkjet head with the filler solution containing a hydrolyzate of a silicon compound which has a hydrophilic group before use of the inkjet head is started, an air bubble is continuously prevented from remaining in the inkjet head even after the filler solution is replaced by the ink for starting the use of the inkjet head. Thus, the filler solution of the present invention has not only a function of preventing clogging of the inkjet head during its transportation but also a function of stabilizing ejection characteristics of the inkjet head.

Further, only by a common procedure performed when the inkjet head is transported, i.e., only by filling the inkjet head with the filler solution, an air bubble is prevented from remaining in the inkjet head. That is, an air bubble is prevented from remaining in the inkjet head without providing a special surface treatment on the internal surface of the inkjet head at the time of production of the inkjet head. Thus, the production cost of the inkjet head is reduced.

The hydrophilic group that the hydrolyzate of the silicon compound has may be an amino group.

The hydrolyzate of the silicon compound which has the amino group may be a hydrolyzate of aminoalkyl alkoxysilane. Alternatively, the hydrolyzate of the silicon compound which has the amino group may be a hydrolyzate of aminoalkyl alkoxysilane and tetraalkoxysilane.

Preferably, the filler solution further contains a monoalcohol. With a monoalcohol, the surface tension of the filler solution is decreased. Accordingly, the fillability of the filler solution into the inkjet head is improved. It should be noted that a monoalcohol added to the filler solution does not inhibit the hydrolyzate of the silicon compound from attaching to the internal surface of inkjet head.

The inkjet head of the present invention is an inkjet head for ejecting ink present in an ink passage through a nozzle which is in communication with the ink passage.

This inkjet head includes a filler solution supplied in place of the ink to fill the ink passage. The filler solution contains water and a hydrolyzate of a silicon compound which has an amino group.

The "ink passage" used herein refers to an internal portion of the ink-jet head which is to be filled with ink. Specifically, the "ink passage" of a piezo-type ink-jet head, for example, includes at least a pressure room for applying a pressure on ink, an ink supply passage for supplying the ink to the pressure room, and an ink ejection passage which establishes a communication between the pressure room and a nozzle.

A recording apparatus of the present invention is a recording apparatus for ejecting ink from an inkjet head toward a recording medium for recording.

This recording apparatus includes a filler solution which is supplied in place of the ink to fill the inkjet head. The filler solution contains water and a hydrolyzate of a silicon compound which has an amino group.

DESCRIPTION OF THE PREFERRED EMBODIMENTS

Structure of Recording Apparatus

Figure 1:
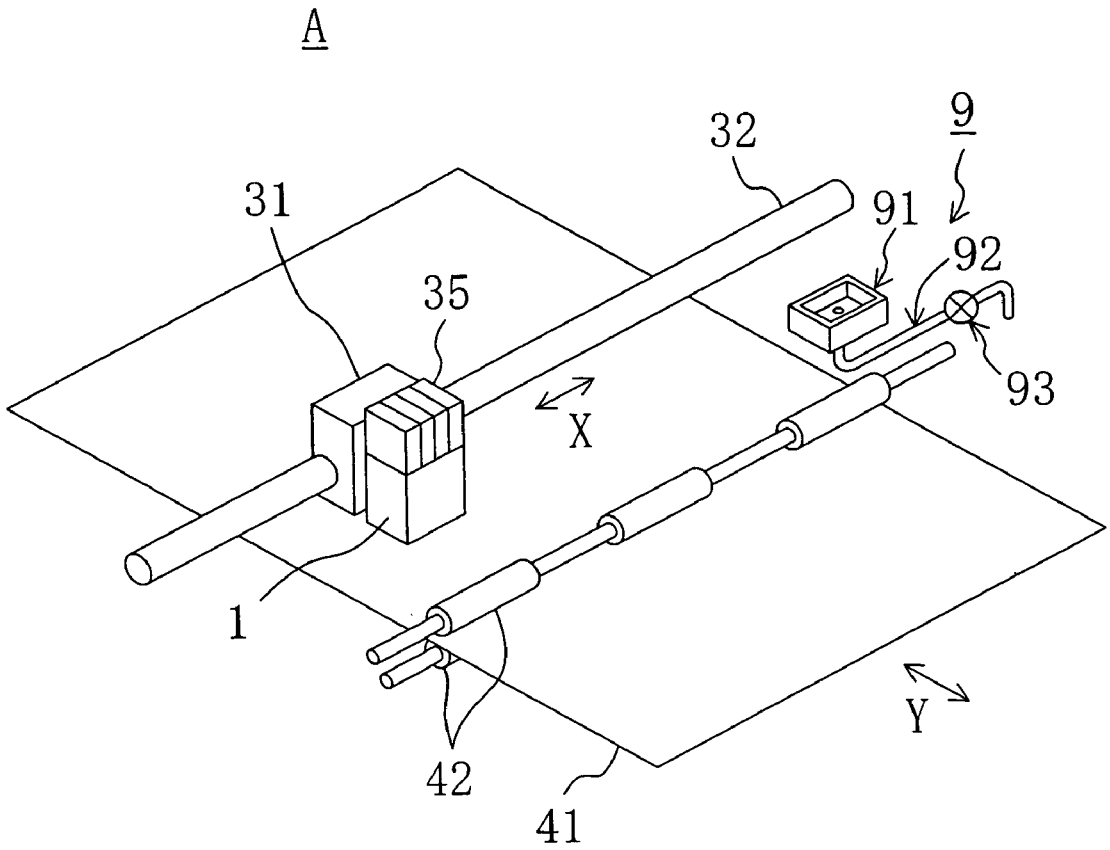
FIG. 1 is a general perspective view showing an inkjet-type recording apparatus according to an embodiment of the present invention.

FIG. 1 generally shows an inkjet-type recording apparatus A according to an embodiment of the present invention. The recording apparatus A has an ink-jet head 1. The inkjet head 1 ejects the ink onto recording paper 41 in a manner described later. On the upper surface of the inkjet head 1, an ink cartridge 35 including the ink is attached.

The inkjet head 1 is fixedly supported by a carriage 31. The carriage 31 is provided with a carriage motor (not shown). The inkjet head 1 and the carriage 31 are reciprocated by the carriage motor along a major scanning direction (X direction in FIGS. 1 and 2) while being guided by a carriage shaft 32 that extends along the major scanning direction.

The recording paper 41 is sandwiched by two transfer rollers 42 which are rotated by a transfer motor (not shown). Under the inkjet head 1, the recording paper 41 is transferred by the transfer motor and transfer rollers 42 along the minor scanning direction which is perpendicular to the major scanning direction (Y direction in FIGS. 1 and 2).

As described above, the recording apparatus A is structured such that the inkjet head 1 and the recording paper 41 are relatively moved with respect to each other by the carriage 31, the carriage shaft 32 and the carriage motor, and the transfer rollers 42 and the transfer motor.

Figure 2:
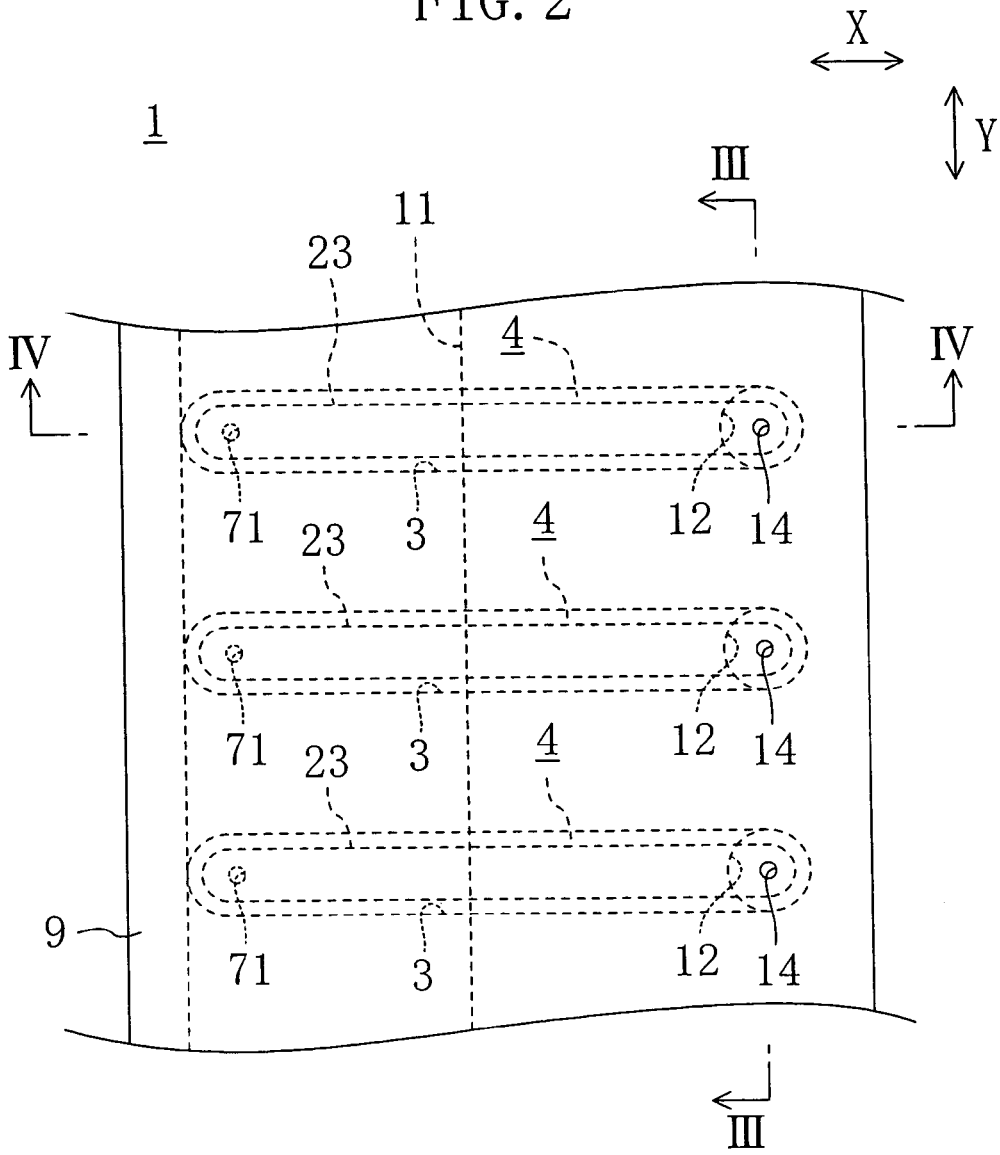
FIG. 2 shows a portion of a bottom surface of an inkjet head of the inkjet-type recording apparatus.
Figure 3:
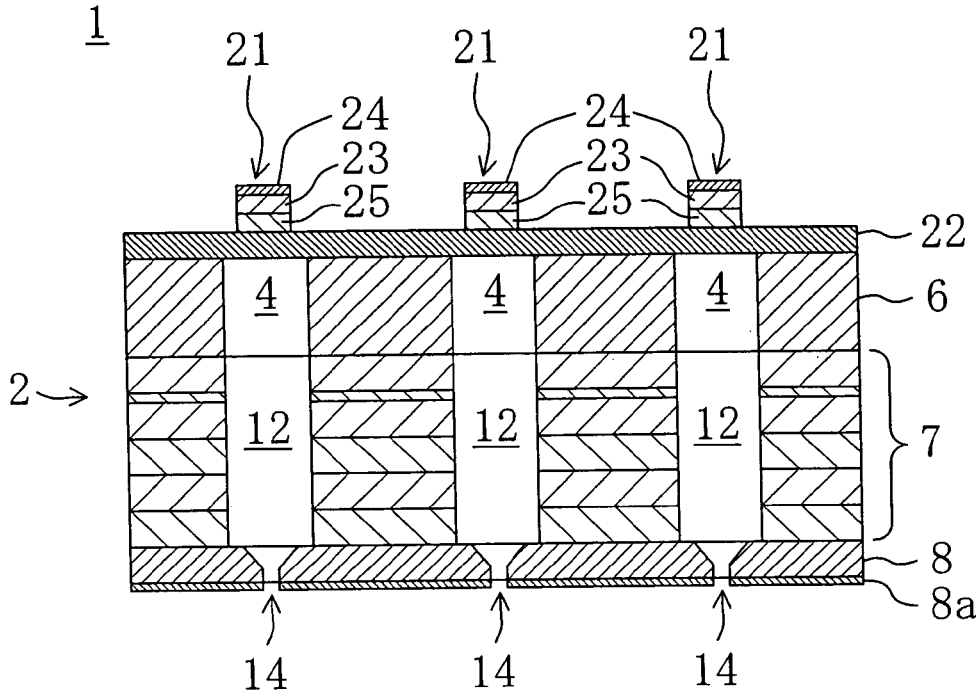
FIG. 3 is a cross-sectional view taken along line III—III of FIG. 2.
Figure 4:
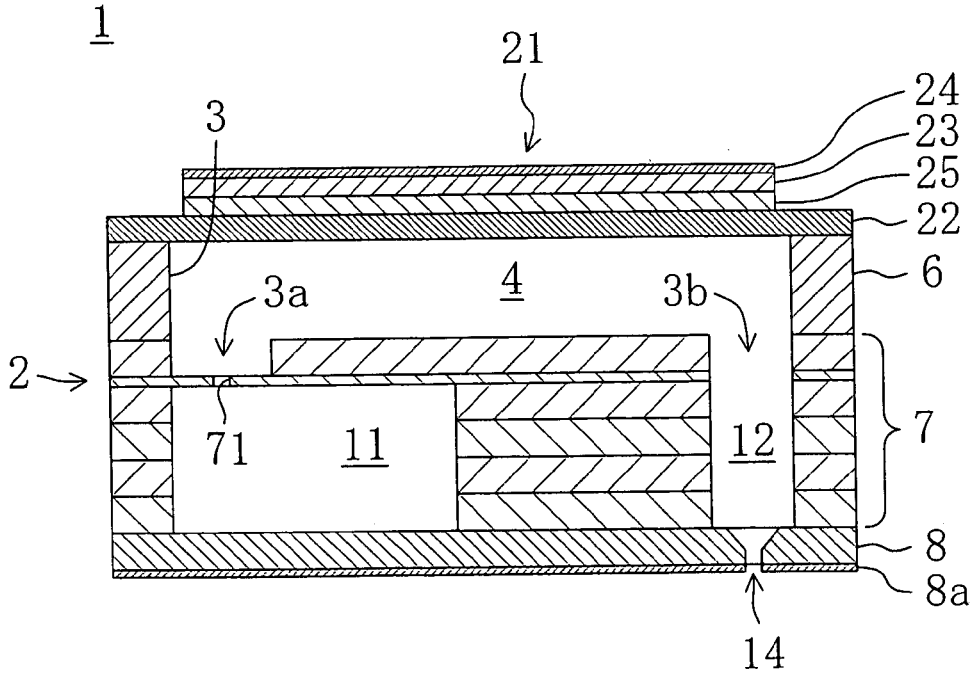
FIG. 4 is a cross-sectional view taken along line IV—IV of FIG. 2.

Referring to FIGS. 2 through 4, the inkjet head 1 includes a head main body 2. The head main body 2 has a plurality of concaved portions 3 for pressure rooms. Each of the concaved portions 3 of the head main body 2 has a supply hole 3*a* for supplying ink and an ejection hole 3*b* for ejecting the ink. The concaved portions 3 are opened in the upper surface of the head main body 2 such that the openings extend along the major scanning direction, and arranged along the minor scanning direction with generally-equal intervals therebetween. The length of the opening of each concaved portion 3 is set to about 1250 μm, and the width thereof is set to about 130 μm. Opposite ends of the opening of each concaved portion 3 have a generally-semicircular shape.

A side wall of each concaved portion 3 is formed by a pressure room member 6 made of photosensitive glass having a thickness of about 200 μm. A bottom wall of each concaved portion 3 is formed by an ink passage member 7 which is adhesively fixed onto the lower surface of the pressure room member 6. The ink passage member 7 is a laminate of six thin plates of stainless steel. The ink passage member 7 has a plurality of orifices 71, one ink supply passage 11, and a plurality of ink ejection passages 12. Each of the orifices 71 is connected to the supply hole 3*a* of a corresponding one of the concaved portions 3. The ink supply passage 11 extends along the minor scanning direction and is connected to the orifices 71. Each of the ink ejection passages 12 is connected to the ejection hole 3*b* of a corresponding one of the concaved portions 3.

Each orifice 71 is formed in the thin stainless steel plate which is the second from the top of the ink passage member 7, and whose thickness is smaller than the others. The diameter of the orifice 71 is set to about 38 μm. The ink supply passage 11 is connected to the ink cartridge 35, such that the ink is supplied from the ink cartridge 35 into the ink supply passage 11.

A nozzle plate 8 made of stainless steel is adhesively fixed onto the lower surface of the ink passage member 7. The nozzle plate 8 has a plurality of nozzles 14 for ejecting ink drops toward the recording paper 41. The lower surface of the nozzle plate 8 is covered with a water-repulsive film 8*a*. The nozzles 14 are aligned in a row on the lower surface of the inkjet head 1 along the minor scanning direction. The nozzles 14 are connected to the ink ejection passages 12 so as to have a communication with the ejection holes 3*b* of the concaved portions 3 through the ink ejection passages 12. Each nozzle 14 includes a tapered portion, where the nozzle diameter gradually decreases along a direction toward a nozzle tip side, and a straight portion provided at the nozzle tip side of the tapered portion. The nozzle diameter of the straight portion is set to about 20 μm.

Piezoelectric actuators 21 are provided above the concaved portions 3 of the head main body 2. Each of the piezoelectric actuators 21 has a diaphragm 22 made of Cr. The diaphragm 22 is adhesively fixed onto the upper surface of the head main body 2 so as to cover the concaved portions 3 of the head main body 2, such that the diaphragm 22 and the concaved portions 3 form pressure rooms 4. The diaphragm 22 is made of a single plate which is commonly used for all of the actuators 21. The diaphragm 22 also functions as a common electrode which is commonly used for all of piezoelectric elements 23 (described later).

Each piezoelectric actuator 21 has a piezoelectric element 23 made of lead zirconate titanate (PZT) and an individual electrode 24 made of Pt. On a surface of the diaphragm 22 which is opposite to the pressure room 4 (i.e., the upper surface of the diaphragm 22), an intermediate layer 25 made of Cu is provided at a portion of the surface which corresponds to the pressure room 4 (a portion above the opening of the concaved portion 3), and the piezoelectric element 23 is provided on the intermediate layer 25. The individual electrode 24 is bonded onto a surface of the piezoelectric element 23 which is opposite to the diaphragm 22 (i.e., the upper surface of the piezoelectric element 23). Each individual electrode 24 functions together with the diaphragm 22 to apply a voltage (driving voltage) to a corresponding one of the piezoelectric elements 23.

All of the diaphragm 22, the piezoelectric elements 23, the individual electrodes 24 and the intermediate layers 25 are formed of thin films. The thickness of the diaphragm 22 is set to about 6 μm. The thickness of each piezoelectric element 23 is set to 8 μm or smaller (e.g., about 3 μm). The thickness of each individual electrode 24 is set to about 0.2 μm. The thickness of each intermediate layer 25 is set to about 3 μm.

Each piezoelectric actuator 21 applies a driving voltage to the piezoelectric element 23 through the diaphragm 22 and the individual electrode 24, thereby deforming a portion of the diaphragm 22 which corresponds to the pressure room 4 (a portion of the diaphragm 22 at the opening of the concaved portion 3). As a result of the deformation of the diaphragm 22, the ink in the pressure room 4 is ejected from the nozzle 14 through the ejection hole 3*b*. That is, when a pulse-shaped voltage is applied between the diaphragm 22 and the individual electrode 24, the piezoelectric element 23 shrinks in the width direction of the piezoelectric element 23, which is perpendicular to the thickness direction thereof, in response to a rising edge of the pulse voltage because of a piezoelectric effect. On the other hand, the diaphragm 22, the individual electrode 24 and the intermediate layer 25 do not shrink even when the pulse voltage is applied. As a result, a portion of the diaphragm 22 which corresponds to the pressure room 4 is flexibly deformed into the shape of a convex toward the pressure room 4 because of a so-called bimetal effect. This flexible deformation increases the pressure inside the pressure room 4, and because of this increased pressure, the ink in the pressure room 4 is squeezed out of the nozzle 14 through the ejection hole 3*b* and the ink ejection passages 12. Then, the piezoelectric element 23 expands in response to a falling edge of the pulse voltage so that the portion of the diaphragm 22 which corresponds to the pressure room 4 recovers its original shape. At this time, the ink squeezed out of the nozzle 14 is separated from the ink remaining in the ink ejection passage 12, whereby the separated ink is released as an ink drop (e.g., 3 pl) toward the recording paper 41. The released ink drop adheres onto the recording paper 41 in the form of a dot. On the other hand, when the diaphragm 22 flexibly deformed in the shape of a convex recovers its original shape, the pressure room 4 is charged with ink supplied from the ink cartridge 35 through the ink supply passage 11 and the supply hole 3*a*. The pulse voltage applied to the piezoelectric elements 23 is not limited to the voltage of push-up/pull-down type as described above, but may be a voltage of pull-down/push-up type which falls from the first voltage to the second voltage that is lower than the first voltage and then rises to the first voltage.

The application of the driving voltage to each piezoelectric element 23 is performed at a predetermined time interval (for example, about 50 μm: driving frequency=20 kHz) while the inkjet head 1 and the carriage 31 are moved from one edge to the other edge of the recording paper 41 at a generally uniform speed along the major scanning direction. It should be noted, however, that the voltage is not applied when the inkjet head 1 resides above a portion of the recording paper 41 where an ink drop is not to be placed. In this way, an ink drop is placed at a predetermined position. After recording of one scanning cycle completes, the recording paper 41 is transferred by a predetermined distance along the minor scanning direction by the transfer motor and the transfer rollers 42. Then, ink drops are ejected again while the inkjet head 1 and the carriage 31 are moved along the major scanning direction, whereby recording of another one scanning cycle is performed. This operation is repeated until a desired image is formed over the recording paper 41.

As shown in FIG. 1, the recording apparatus A further includes suction means 9 for cleaning the inkjet head 1.

The suction means 9 is provided in the vicinity of one end of the carriage shaft 32 that extends along the major scanning direction. The position at which the suction means 9 is provided corresponds to the home position of the inkjet head 1 that reciprocates along the major scanning direction. The home position is a place which is offset along the major scanning direction with respect to the recording paper 41 and at which the inkjet head 1 stays while the inkjet head 1 does not engage in the formation of an image.

The suction means 9 includes a generally box-shaped rubber cap 91 whose upper face is opened, a tube 92 which is connected to a through-hole formed in the bottom of the cap 91, and a suction pump 93 inserted at an intermediate position of the tube 92.

The cap 91 is designed to come into tight contact with the lower surface of the inkjet head 1. The cap 91 moves upward and downward. Specifically, the cap 91 alternatively changes its position between a tight contact position and a retreat position. At the tight contact position, the cap 91 is in tight contact with the lower surface of the inkjet head 1 that is present at its home position. At the retreat position, the cap 91 is apart from the lower surface of the inkjet head 1.

The cleaning of the inkjet head 1 is carried out by activating the suction pump 93 while the cap 91 is in tight contact with the inkjet head 1. As a result, a closed space formed by the cap 91 and the inkjet head 1 is turned into a negative pressure state, whereby ink is sucked from an opening of the nozzle 14. With such a mechanism, an ink clot (coagulated ink) attached to an area in the vicinity of the opening of the nozzle 14 is removed and/or an air bubble remaining in the inkjet head 1 is expelled from the nozzle 14.

The recording apparatus A executes the cleaning operation by the suction means 9 at a timing when recording of an image is started after a long interval or at a timing when a user manipulates a cleaning switch (not shown).

When the ink cartridge 35 is attached to the inkjet head 1 for the first time at the time of the initial use of the recording apparatus A, the filler solution contained in the inkjet bead 1 is replaced by ink in a manner described below. Also at this timing, the recording apparatus A executes the cleaning operation.

Ink Composition

The ink composition used in the recording apparatus A may be basically any type of ink composition. One example of the ink composition is a water-resistant ink composition containing a colorant, a humectant for suppressing drying of the ink in the nozzle 14 of the inkjet head 1, or the like, a penetrant for enhancing the permeability of the ink (solvent) into the recording medium 41, water, and a water-soluble substance that is condensation-polymerized in the absence of the water.

When an ink drop ejected from the nozzle 14 of the inkjet head 1 is adhered onto the recording medium 41, and the water content (solvent) evaporates or permeates into the recording medium 41, the water-soluble substance is condensation-polymerized on the recording medium 41 to enclose the colorant. Because of this mechanism, even when an image formed with this ink composition on the recording medium 41 is exposed to water, the colorant is prevented from exuding into the water, and as a result, the water-resistivity of the image is improved. Specific examples of such a water-soluble substance include a hydrolyzable silane compound and a hydrolyzable titan compound. Among these examples, the hydrolyzable silane compound (organic silicon compound) is especially preferable in consideration of dissolution stability.

More preferably, the water-soluble substance is a compound having an amino group. In the case of employing a compound having an amino group, an interaction between the water-soluble substance and the colorant is strong so that the water-soluble substance securely encloses the colorant when the water-soluble substance is condensation-polymerized.

A preferable organic silicon compound is a reaction product of hydrolysis of alkoxysilane containing an organic group that has an amino group and alkoxysilane not containing an amino group. Another preferable organic silicon compound is an organic silicon compound obtained by hydrolysis of a hydrolyzable silane that is produced by reacting an organic monoepoxy compound with a hydrolyzable silane having an amino group and a hydrolyzable silane not containing a nitrogen atom.

It should be noted that the penetrant is not an indispensable constituent of the ink composition. However, in the case where the penetrant is added to the ink composition, the solvent permeates into the print material 41 more quickly. Accordingly, the water-resistivity of an image is more improved.

Furthermore, a water-soluble substance that is condensation-polymerized in the absence of water is also not an indispensable constituent of the ink composition. Thus, the ink composition does not need to contain such a water-soluble substance. However, when the water-soluble substance is not contained in the ink composition, the water-resistivity of an image formed on the recording paper 41 decreases.

Composition of Filler Solution

The filler solution is supplied in place of the ink composition to fill the inside of the inkjet head 1, i.e., the pressure room 4, the ink supply passage 11 and the ink ejection passages 12, when the recording apparatus A is transported (e.g., at the time of shipment from its manufacturer). With the supplied filler solution, clogging of the nozzle 14 is prevented.

The filler solution of the present invention contains water, a hydrolyzate of a silicon compound which has a hydrophilic group, and a monoalcohol.

The hydrophilic group of the silicon compound is preferably an amino group. The hydrolyzate of the silicon compound which has the amino group is preferably a hydrolyzate of aminoalkyl alkoxysilane.

Specific examples of aminoalkyl alkoxysilane include the following compounds:

$NH_2CH_2CH_2CH_2Si(OCH_3)_3$; $NH_2(CH_2)_4Si(OCH_3)_3$; $NH_2(CH_2)_5Si(OCH_3)_3$;

$NH_2(CH_2)_6Si(OCH_3)_3$; $NH_2(CH_2)_7Si(OCH_3)_3$; $NH_2(CH_2)_8Si(OCH_3)_3$;

$NH_2(CH_2)_9Si(OCH_3)_3$; $NH_2(CH_2)_{10}Si(OCH_3)_3$; $NH_2CH_2CH_2NHCH_2CH_2CH_2Si(OCH_3)_3$;

$NH_2(CH_2)_6NHCH_2CH_2CH_2Si(OCH_3)_3$.

The hydrolyzate of the silicon compound which has an amino group may be a hydrolyzate of aminoalkyl alkoxysilane and tetraalkoxysilane.

Specific examples of the monoalcohol include ethanol, isopropylalcohol, and n-propylalcohol.

Figure 5:
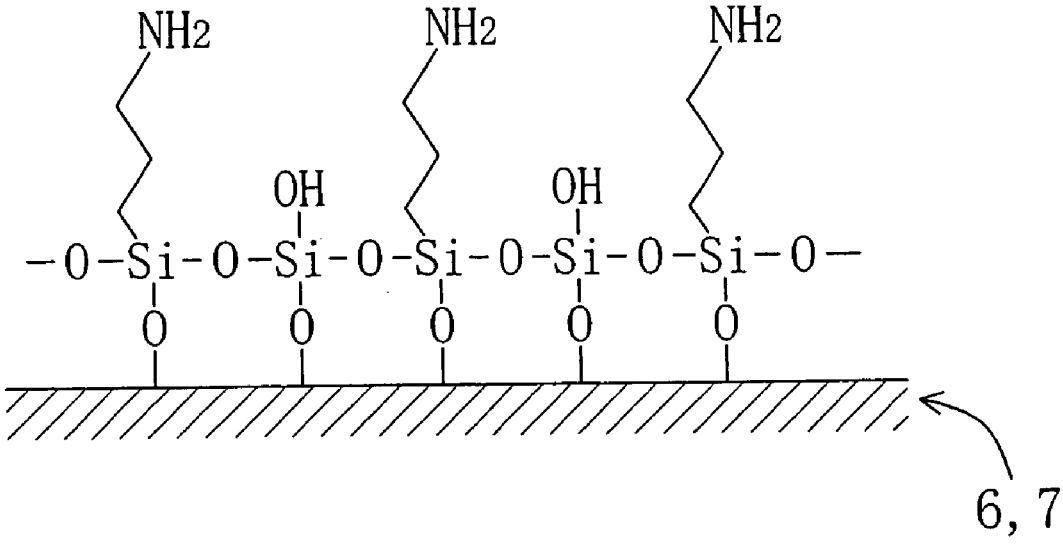
FIG. 5 is an enlarged cross-sectional view of an internal surface of the inkjet head, which is shown at the level of molecules.

The filler solution of this embodiment further contains a hydrolyzate of a silicon compound. When the filler solution is supplied to fill the inkjet head 1, a silanol portion of the hydrolyzate of the silicon compound is chemisorbed on a surface made of stainless steel or glass which forms the internal surface of the inkjet head 1 (surface of the pressure room member 6 or ink passage member 7) as shown in FIG. 5. Since the hydrolyzate of the silicon compound has a hydrophilic group (amino group), the internal surface of the inkjet head 1 becomes hydrophilic. In this way, the inkjet head 1 is filled with the filler solution before the shipment of the recording apparatus A. After receiving the recording apparatus A, a user attaches the ink cartridge 35 to the inkjet head 1, and the filler solution in the inkjet head 1 is replaced by the ink contained in the ink cartridge 35. When the filler solution is replaced by the ink, the piezoelectric actuator 21 of the ink-jet head 1 is appropriately activated and, on the other hand, the cleaning operation by the suction means 9 is carried out.

Even if an air bubble is trapped in the inkjet head 1 at the time of replacement of the filler solution by the ink, attaching of the air bubble to the internal surface of the inkjet head 1 is suppressed because the internal surface of the inkjet head 1 is hydrophilic due to the filler solution as described above. As a result, the air bubble trapped in the inkjet head 1 is evacuated out of the inkjet head 1 together with the filler solution (or ink) ejected from the nozzle 14, or is evacuated out of the inkjet head by the cleaning operation. Thus, the air bubble does not remain in the inkjet head 1. Accordingly, ejection failure of the inkjet head 1 is prevented.

Especially when the filler solution in the inkjet head 1 is replaced by water-resistant ink containing a water-soluble substance that is condensation-polymerized in the absence of water (e.g., hydrolyzable silane compound), a relatively large number of air bubbles are trapped in the inkjet head 1 because this water-resistant ink has a relatively-high viscosity. However, even when a large number of air bubbles are trapped in the inkjet head 1, the air bubbles are readily evacuated out of the inkjet head 1 because the internal surface of the inkjet head 1 is hydrophilic. Thus, no air bubbles remains in the inkjet head 1.

Further, even if an air bubble is trapped in the inkjet head 1 when a vacant (i.e., exhausted) ink cartridge 35 is exchanged with a new one, the trapped air bubble is readily evacuated out of the inkjet head 1. Furthermore, even if gas (oxygen or the like) dissolved in the ink is expanded due to a change in the internal pressure of the ink-jet head 1 to emerge as an air bubble in the inkjet head 1, the air bubble that emerged is readily evacuated out of the inkjet head 1.

By filling the inkjet head 1 with the filler solution containing a hydrolyzate of a silicon compound which has a hydrophilic group at the time of shipment of the ink-jet head 1 as described above, the air bubble is continuously prevented from remaining in the inkjet head 1 even after the filler solution is replaced by the ink for starting the use of the inkjet head 1. As a result, the ejection characteristics of the inkjet head 1 are stabilized.

In the case where the filler solution contains a monoalcohol, the surface tension of the filler solution is decreased. Accordingly, the fillability of the filler solution is increased so that the filler solution can readily fill the inkjet head 1. It should be noted that even if a monoalcohol is added to the filler solution, the monoalcohol does not inhibit a silanol portion of the hydrolyzate of the silicon compound from attaching to the internal surface of inkjet head 1. Thus, the internal surface of inkjet head 1 can surely be modified to be hydrophilic.

It should be noted that the inkjet head 1 which is to be filled with the filler solution of this embodiment is not limited to the above-described piezo-type inkjet head but may be a bubble jet-type ink-jet.

Next, specific examples of this embodiment are described.

In the first place, 10 types of filler solutions which have the following compositions were prepared (Examples 1–10). It should be noted that the contents of the constituents of each composition are shown in percentage by mass.

EXAMPLE 1

A hydrolyzate of a silicon compound which has an amino group, which is a constituent of a filler solution of Example 1, was prepared by the following method. First, 180 g (10 mol) of water was poured in a reactor which has a cooler attached thereto. Then, 100 g (0.56 mol) of $NH_2CH_2CH_2CH_2Si(OCH_3)_3$ was added to the water in a drop-by-drop fashion while stirring the water. After all of $NH_2CH_2CH_2CH_2Si(OCH_3)_3$ was dropped, the temperature of the reactor was increased to 60° C., and stirring was continued for one hour. Thereafter, the temperature of the reactor was increased to 90° C., and the reaction was continued for 2 hours while stirring the content of the reactor. After the end of the reaction, generated methanol was removed by distillation. A resultant product obtained after the above process is hydrolyzate (A1) of a silicon compound (hereinafter, "silicon compound hydrolyzate (A1)"), which is contained in the filler solution of Example 1.

| | |
|---|---|
| silicon compound hydrolyzate (A1) | 5% |
| pure water | 95% |

EXAMPLE 2

Hydrolyzate (A2) of a silicon compound, which is a constituent of a filler solution of Example 2, was prepared by the method described in Example 1 using $NH_2(CH_2)_4Si(OCH_3)_3$ in place of $NH_2CH_2CH_2CH_2Si(OCH_3)_3$ of silicon compound hydrolyzate (A1).

| | |
|---|---|
| silicon compound hydrolyzate (A2) | 5% |
| pure water | 95% |

EXAMPLE 3

Hydrolyzate (A3) of a silicon compound, which is a constituent of a filler solution of Example 3, was prepared by the method described in Example 1 using $NH_2(CH_2)_5Si(OCH_3)_3$ in place of $NH_2CH_2CH_2CH_2Si(OCH_3)_3$ of silicon compound hydrolyzate (A1).

| | |
|---|---|
| silicon compound hydrolyzate (A3) | 5% |
| pure water | 95% |

EXAMPLE 4

Hydrolyzate (A4) of a silicon compound, which is a constituent of a filler solution of Example 4, was prepared by the method described in Example 1 using $NH_2CH_2CH_2NHCH_2CH_2CH_2Si(OCH_3)_3$ in place of $NH_2CH_2CH_2CH_{@2}Si(OCH_3)_3$ of silicon compound hydrolyzate (A1).

| | |
|---|---|
| silicon compound hydrolyzate (A4) | 5% |
| pure water | 95% |

EXAMPLE 5

Hydrolyzate (A5) of a silicon compound, which is a constituent of a filler solution of Example 5, was prepared by the method described in Example 1 using $NH_2(CH_2)_6NHCH_2CH_2CH_2Si(OCH_3)_3$ in place of $NH_2CH_2CH_2CH_{@2}Si(OCH_3)_3$ of silicon compound hydrolyzate (A1).

| | |
|---|---|
| silicon compound hydrolyzate (A5) | 5% |
| pure water | 95% |

EXAMPLE 6

The filler solution of Example 6 was prepared by further adding ethanol to the filler solution of Example 1.

| | |
|---|---|
| silicon compound hydrolyzate (A1) | 5% |
| ethanol | 5% |
| pure water | 90% |

EXAMPLE 7

The filler solution of Example 7 was prepared by further adding isopropylalcohol to the filler solution of Example 2.

| | |
|---|---|
| silicon compound hydrolyzate (A2) | 5% |
| isopropylalcohol | 5% |
| pure water | 90% |

EXAMPLE 8

The filler solution of Example 8 was prepared by further adding n-propylalcohol to the filler solution of Example 3.

| | |
|---|---|
| silicon compound hydrolyzate (A3) | 5% |
| n-propylalcohol | 5% |
| pure water | 90% |

EXAMPLE 9

The filler solution of Example 9 was prepared by further adding ethanol to the filler solution of Example 4.

| | |
|---|---|
| silicon compound hydrolyzate (A4) | 5% |
| ethanol | 5% |
| pure water | 90% |

EXAMPLE 10

The filler solution of Example 10 was prepared by further adding isopropylalcohol to the filler solution of Example 5.

| | |
|---|---|
| silicon compound hydrolyzate (A5) | 5% |
| isopropylalcohol | 5% |
| pure water | 90% |

For comparison, 2 types of filler solutions which have the following compositions were prepared (Comparative Examples 1 and 2). (It should be noted that the contents of the constituents of each composition are shown in percentage by mass.) These solutions do not contain a hydrolyzate of a silicon compound.

COMPARATIVE EXAMPLE 1

| | |
|---|---|
| triethyleneglycol monomethylether | 5% |
| N-(β-aminoethyl)ethanolamine | 5% |
| pure water | 90% |

COMPARATIVE EXAMPLE 2

| | |
|---|---|
| triethylamine | 5% |
| glycerol | 5% |
| diethyleneglycol | 5% |
| pure water | 85% |

An ink composition used herein has the following composition. The ink composition is a water-resistant ink composition which contains silicon compound hydrolyzate (A1), i.e., a water-soluble substance that is condensation-polymerized in the absence of water.

| | |
|---|---|
| C.I. Acid Red 289 | 5% |
| 1,3-butanediol | 12% |
| silicon compound hydrolyzate (A1) | 5% |
| diethyleneglycol monobutylether | 5% |
| 2-butoxyethanol | 3% |
| pure water | 70% |

Each of the filler solutions of Examples 1–10 and Comparative Examples 1 and 2 was supplied to fill an inkjet head mounted on a commercially-available printer (product name "EM-930C"; produced by SEIKO EPSON Co.). Then, the filler solution in the inkjet head was replaced by the above-described water-resistant ink composition, and a dot pattern was printed with the printer. With this process, the ejectability of the ink composition was examined.

When the inkjet head filled with the filler solution of Comparative Example 1 was employed, ejection failure occurred in 7 pins (7 nozzles) out of all the nozzles of this inkjet head. When the inkjet head filled with the filler solution of Comparative Example 2 was employed, ejection failure occurred in 5 pins. In these cases, the number of pins in which ejection failure occurred was not decreased even after the cleaning of the inkjet head was performed 10 times in succession.

On the other hand, when the inkjet head filled with the filler solution of each of Examples 1–10 was employed, ejection failure did not occur in any of the nozzles.

Furthermore, it was confirmed that, even if a commonly-employed ink composition (ink composition not containing a hydrolyzate of a silicon compound) was used in place of the water-resistant ink composition, ejection failure of the inkjet head did not occur when the filler solution of each of Examples 1–10 was used.

What is claimed is:

1. A filler solution for an inkjet head which is provided to fill the inkjet head, comprising water and a hydrolyzate of a silicon compound of an alkoxysilane, wherein the compound has a hydrophilic group, the filler solution being disposed within the inkjet head before the recording is performed using the ink and the filler solution is removed from the inkjet head when the recording is performed using the ink.

2. A filler solution according to claim 1, wherein the hydrophilic group is an amino group.

3. A filler solution according to claim 1 wherein the hydrophilic group is an amino group; and wherein the hydrolyzate of the silicon compound which has the amino group is a hydrolyzate of aminoalkyl alkoxysilane.

4. A filler solution according to claim 1 wherein the hydrophilic group is an amino group; and wherein the hydrolyzate of the silicon compound which has the amino group is a hydrolyzate of aminoalkyl alkoxysilane and tetraalkoxysilane.

5. A filler solution according to claim 1, further comprising a monoalcohol.

6. A recording apparatus in which ink is ejected from an inkjet head toward a recording medium for recording, comprising a filler solution provided in place of the ink to fill the ink passage, wherein the filler solution contains water and a hydrolyzate of a silicon compound of an alkoxysilane, wherein the compound has an amino group, wherein the recording apparatus is filled with the filler solution beforehand and the recording is performed by using the ink after the filler solution is removed from the inkjet head.

7. A recording apparatus according to claim 6, wherein the hydrolyzate of the silicon compound which has the amino group is a hydrolyzate of aminoalkyl alkoxysilane.

8. A recording apparatus according to claim 6, wherein the hydrolyzate of the silicon compound which has the amino group is a hydrolyzate of aminoalkyl alkoxysilane and tetraalkoxysilane.

9. The recording apparatus according to claim 6, wherein said filler solution is substantially devoid of colorant.

10. A method of preventing air bubble accumulation on an internal surface of an inkjet head comprising:

filling an inkjet head with a filler composition comprising a hydrolyzate of a silicon compound having a hydrophilic group; and replacing the filler composition with ink, wherein the hydrophilic group of the filler composition suppresses attachment of air bubbles to the internal surface and air bubbles are removed from the inklet head.

* * * * *

UNITED STATES PATENT AND TRADEMARK OFFICE

CERTIFICATE OF CORRECTION

PATENT NO. : 7,188,926 B2
APPLICATION NO. : 10/456445
DATED : March 13, 2007
INVENTOR(S) : Mamoru Soga et al.

It is certified that error appears in the above-identified patent and that said Letters Patent is hereby corrected as shown below:

COL. 14

Line 36, Claim 10, "inklet" should be -- inkjet --

Signed and Sealed this

Fifth Day of June, 2007

JON W. DUDAS
*Director of the United States Patent and Trademark Office*